US006253550B1

(12) United States Patent
Langenfeld et al.

(10) Patent No.: US 6,253,550 B1
(45) Date of Patent: Jul. 3, 2001

(54) FOLDED GUIDE LINK STIRLING ENGINE

(75) Inventors: Christopher C. Langenfeld, Nashua; Stanley B. Smith, III, Chester, both of NH (US)

(73) Assignee: New Power Concepts LLC, Manchester, NH (US)

( * ) Notice: Subject to any disclaimer, the term of this patent is extended or adjusted under 35 U.S.C. 154(b) by 0 days.

(21) Appl. No.: 09/335,392

(22) Filed: Jun. 17, 1999

(51) Int. Cl.[7] ..... F01B 29/10
(52) U.S. Cl. ..... 60/518; 60/525
(58) Field of Search ..... 60/517, 518, 525

(56) References Cited

U.S. PATENT DOCUMENTS

| | | | |
|---|---|---|---|
| 55,516 | 6/1866 | Winans et al. . | |
| 120,222 | 10/1871 | Van Emon . | |
| 124,805 | 3/1872 | Fryer . | |
| 321,313 | 6/1885 | Pinkham . | |
| 488,373 | 12/1892 | Touch . | |
| 1,089,651 | 3/1914 | Kovalavich . | |
| 1,769,375 | 7/1930 | Leary . | |
| 1,840,389 | 1/1932 | Eubank . | |
| 1,866,702 | 7/1932 | Gehres . | |
| 2,170,099 | 8/1939 | Stubings | 123/56 |
| 3,059,418 | 10/1962 | Johnston | 60/24 |
| 3,431,788 | 3/1969 | du Pré | 74/44 |
| 3,861,223 | 1/1975 | Braun et al. | 74/44 |
| 3,924,477 | 12/1975 | Portelance | 74/44 |
| 4,020,635 * | 5/1977 | Joynes et al. | 60/517 X |
| 4,169,692 | 10/1979 | McDonough et al. | 415/115 |
| 4,330,992 | 5/1982 | Senft | 60/518 |
| 4,442,670 * | 4/1984 | Goldman | 60/517 |
| 4,898,041 | 2/1990 | Islas | 74/44 |
| 5,771,694 | 6/1998 | Houtman et al. | 60/517 |

FOREIGN PATENT DOCUMENTS

| | | |
|---|---|---|
| 445033 | 12/1922 | (DE) . |
| 40 18943 A1 | 12/1991 | (DE) . |
| 42 05 283 A1 | 8/1993 | (DE) . |
| 2 067 119 | 8/1971 | (FR) . |
| 2 271 982 A1 | 1/1996 | (FR) . |

* cited by examiner

*Primary Examiner*—Hoang Nguyen
(74) *Attorney, Agent, or Firm*—Bromberg & Sunstein LLP

(57) ABSTRACT

A folded linkage for coupling a crankshaft and a piston undergoing reciprocating linear motion along a longitudinal axis. The folded linkage has a guide link with a first end coupled to the piston. A connecting rod couples the distal end of the guide link to the crankshaft which rotates about an axis that is orthogonal to the longitudinal axis of piston motion and located between the proximal end and the distal end of the guide link. A guide link guide assembly supports lateral loads on the guide link at its distal end. The folded linkage may be applied to couple the compression piston and displacer piston of a Stirling cycle machine to a common crankshaft.

32 Claims, 14 Drawing Sheets

FOLDED GUIDE LINK STIRLING ENGINE

TECHNICAL FIELD

The present invention pertains to improvements to an engine and more particularly to improvements relating to mechanical components of a Stirling cycle heat engine or refrigerator which contribute to increased engine operating efficiency and lifetime, and to reduced size, complexity and cost.

BACKGROUND OF THE INVENTION

Stirling cycle machines, including engines and refrigerators, have a long technological heritage, described in detail in Walker, *Stirling Engines*, Oxford University Press (1980), herein incorporated by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression. The Stirling cycle refrigerator is also the mechanical realization of a thermodynamic cycle which approximates the ideal Stirling thermodynamic cycle. In an ideal Stirling thermodynamic cycle, the working fluid undergoes successive cycles of isovolumetric heating, isothermal expansion, isovolumetric cooling and isothermal compression. Practical realizations of the cycle, wherein the stages are neither isovolumetric nor isothermal, are within the scope of the present invention and may be referred to within the present description in the language of the ideal case without limitation of the scope of the invention as claimed.

Various aspects of the present invention apply to both Stirling cycle engines and Stirling cycle refrigerators, which are referred to collectively as Stirling cycle machines in the present description and in any appended claims. The principle of operation of a Stirling cycle engine configured in an 'alpha' configuration and employing a first "compression" piston and a second "expansion" piston is described at length in pending U.S. application Ser. No. 09/115,383, filed Jul. 14, 1998, which is incorporated herein by reference.

The principle of operation of a Stirling engine is readily described with reference to FIGS. 1*a*–1*e*, wherein identical numerals are used to identify the same or similar parts. Many mechanical layouts of Stirling cycle machines are known in the art, and the particular Stirling engine designated generally by numeral 10 is shown merely for illustrative purposes. In FIGS. 1*a* to 1*d*, piston 12 and a displacer 14 move in phased reciprocating motion within cylinders 16 which, in some embodiments of the Stirling engine, may be a single cylinder. Typically, a displacer 14 does not have a seal. However, a displacer 14 with a seal (commonly known as an expansion piston) may be used. Both a displacer without a seal or an expansion piston will work in a Stirling engine in an "expansion" cylinder. A working fluid contained within cylinders 16 is constrained by seals from escaping around piston 12 and displacer 14. The working fluid is chosen for its thermodynamic properties, as discussed in the description below, and is typically helium at a pressure of several atmospheres. The position of displacer 14 governs whether the working fluid is in contact with hot interface 18 or cold interface 20, corresponding, respectively, to the interfaces at which heat is supplied to and extracted from the working fluid. The supply and extraction of heat is discussed in further detail below. The volume of working fluid governed by the position of the piston 12 is referred to as compression space 22.

During the first phase of the engine cycle, the starting condition of which is depicted in FIG. 1*a*, piston 12 compresses the fluid in compression space 22. The compression occurs at a substantially constant temperature because heat is extracted from the fluid to the ambient environment. In practice, a cooler (not shown) is provided. The condition of engine 10 after compression is depicted in FIG. 1*b*. During the second phase of the cycle, displacer 14 moves in the direction of cold interface 20, with the working fluid displaced from the region of cold interface 20 to the region of hot interface 18. This phase may be referred to as the transfer phase. At the end of the transfer phase, the fluid is at a higher pressure since the working fluid has been heated at constant volume. The increased pressure is depicted symbolically in FIG. 1*c* by the reading of pressure gauge 24.

During the third phase (the expansion stroke) of the engine cycle, the volume of compression space 22 increases as heat is drawn in from outside engine 10, thereby converting heat to work. In practice, heat is provided to the fluid by means of a heater (not shown). At the end of the expansion phase, compression space 22 is full of cold fluid, as depicted in FIG. 1*d*. During the fourth phase of the engine cycle, fluid is transferred from the region of hot interface 18 to the region of cold interface 20 by motion of displacer 14 in the opposing sense. At the end of this second transfer phase, the fluid fills compression space 22 and cold interface 20, as depicted in FIG. 1*a*, and is ready for a repetition of the compression phase. The Stirling cycle is depicted in a P-V (pressure-volume) diagram as shown in FIG. 1*e*.

Additionally, on passing from the region of hot interface 18 to the region of cold interface 20, the fluid may pass through a regenerator (not shown). The regenerator may be a matrix of material having a large ratio of surface area to volume which serves to absorb heat from the fluid when it enters hot from the region of hot interface 18 and to heat the fluid when it passes from the region of cold interface 20.

The principle of operation of a Stirling cycle refrigerator can also be described with reference to FIGS. 1*a*–1*e*, wherein identical numerals are used to identify the same or similar parts. The differences between the engine described above and a Stirling machine employed as a refrigerator are that compression volume 22 is typically in thermal communication with ambient temperature and expansion volume 24 is connected to an external cooling load (not shown). Refrigerator operation requires net work input.

Stirling cycle engines have not generally been used in practical applications, and Stirling cycle refrigerators have been limited to the specialty field of cryogenics, due to several daunting engineering challenges to their development. These involve such practical considerations as efficiency, vibration, lifetime, and cost. The instant invention addresses these considerations.

A major problem encountered in the design of certain engines, including the compact Stirling engine, is that of the friction generated by a sliding piston resulting from misalignment of the piston in the cylinder and lateral forces exerted on the piston by the linkage of the piston to a rotating crankshaft. In a typical prior art piston-crankshaft configuration such as that depicted in FIG. 2, a piston 10 executes reciprocating motion along longitudinal direction 12 within cylinder 14. Piston 10 is coupled to an end of connecting rod 16 at a pivot such as a pin 18. The other end 20 of connecting rod 16 is coupled to a crankshaft 22 at a fixed distance 24 from the axis of rotation 26 of the crankshaft. As crankshaft 22 rotates about the axis of rotation 26, the connecting rod end 20 connected to the crankshaft traces a circular path while the connecting rod end 28 connected to the piston 10 traces a linear path 30. The connecting rod angle 32, defined by the connecting rod longitudinal axis 34 and the axis 30 of the piston, will vary as the crankshaft rotates. The maximum connecting rod angle will depend on the connecting rod offset on the crankshaft and on the length of the connecting rod. The force transmitted by the connecting rod may be decomposed into a longitudinal component 38 and a lateral component 40, each acting through pin 18 on piston 10. Minimizing the maximum connecting rod angle 32 will decrease the lateral forces 40 on the piston and thereby reduce friction and increase the mechanical efficiency of the engine. The maximum connecting rod angle can be minimized by decreasing the connecting rod offset 24 on the crankshaft 22 or by increasing the connecting rod length. However, decreasing the connecting rod offset on the crankshaft will decrease the stroke length of the piston and result in less $\Delta(pV)$ work per piston cycle. Increasing the connecting rod length can not reduce the connecting rod angle to zero but does increase the size of the crankcase resulting in a less portable and compact engine.

Referring now to the prior art engine configuration of FIG. 3, it is known that in order to reduce the lateral forces on the piston, a guide link 42 may be used as a guidance system to take up lateral forces while keeping the motion of piston 10 constrained to linear motion. In a guide link design, the connecting rod 16 is replaced by the combination of guide link 42 and a connecting rod 16. Guide link 42 is aligned with the wall 44 of piston cylinder 14 and is constrained to follow linear motion by two sets of rollers or guides, forward rollers 46 and rear rollers 48. The end 50 of guide link 42 is connected to connecting rod 16 which is, in turn, connected to crankshaft 22 at a distance offset from the rotational axis 26 of the crankshaft. Guide link 42 acts as an extension of piston 10 and the lateral forces on the piston that would normally be transmitted to cylinder walls 44 are instead taken up by the two sets of rollers 46 and 48. Both sets of rollers 46 and 48 are required to maintain the alignment of guide link 42 and to take up the lateral forces being transmitted to the guide link by the connecting rod. The distance d between the forward set of rollers and the rear set of rollers may be reduced to decrease the size of the crankcase (not shown). However, reducing the distance between the rollers will increase the lateral load 54 on the forward set of rollers since the rear roller set acts as a fulcrum 56 to a lever 58 defined by the connection point 52 of the guide link and connecting rod 16.

The guide link will generally increase the size of the crankcase because the guide link must be of sufficient length that when the piston is at its maximum extension into the piston cylinder, the guide link extends beyond the piston cylinder so that the two sets of rollers maintain contact and alignment with the guide link.

SUMMARY OF THE INVENTION

In accordance with one aspect of the invention, in one of its embodiments, there is provided a linkage for coupling a piston undergoing reciprocating linear motion along a longitudinal axis to a crankshaft undergoing rotary motion about a rotation axis of the crankshaft. The longitudinal axis and the rotation axis are substantially orthogonal to each other. The linkage has a guide link with a first end proximal to the piston and coupled to the piston, and a second end distal to the piston such that the rotation axis is disposed between the proximal end and the distal end of the guide link. The linkage has a connecting rod with a connecting end and a crankshaft end, the connecting end rotatably connected to the end of the guide link distal to the piston at a rod connection point and the crankshaft end coupled to the crankshaft at a crankshaft connection point offset from the rotation axis of the crankshaft. Finally, the linkage has a guide link guide assembly for supporting lateral loads at the distal end of the guide link. The guide link guide assembly may include a first roller having a center of rotation fixed with respect to the rotation of the crankshaft and a rim in rolling contact with the distal end of the guide link.

In accordance with alternate embodiments of the present invention, a spring mechanism may be provided for urging the rim of the first roller into contact with the distal end of the guide link. In a further embodiment, the guide link guide assembly may include a second roller in opposition to the first roller, the second roller having a center of rotation and a rim in rolling contact with the distal end of the guide link. The second roller may further include a precision positioner to position of the center of rotation of the second roller with respect to the longitudinal axis. In a preferred embodiment, the precision positioner is a vernier mechanism having an eccentric shaft for varying a distance between the center of rotation of the second roller and the longitudinal axis. The ends of the guide link may be formed of different materials and may be detached for replacement of a worn end.

In accordance with another aspect of the present invention, a machine is provided that has a piston with a longitudinal travel axis and a crankshaft capable of rotation about a rotation axis, the rotation axis being substantially orthogonal to the longitudinal axis. The machine has a guide link having a length and a first end proximal to the piston and coupled to the piston and a second end that is distal to the piston such that the rotation axis is disposed between the proximal end and the distal end of the guide link. The machine has a connecting rod with a connecting end and a crankshaft end, the connecting end rotatably connected to the end of the guide link distal to the piston and the crankshaft end coupled to the crankshaft at a crankshaft connection point offset from the rotation axis of the crankshaft. Finally, the guide link is constrained to follow a substantially linear path at a discrete number of points along its length.

In accordance with yet another aspect of the present invention, an improvement is provided to a Stirling cycle machine of the type wherein a displacer piston undergoes reciprocating motion along a first longitudinal axis and a compression piston undergoes reciprocating motion along a second longitudinal axis. As used in this description and the following claims, a displacer piston is either a piston without a seal or a piston with a seal (commonly known as an "expansion" piston). The improvement has a folded guide link linkage for coupling each of the pistons to a crankshaft. In a further embodiment, the improvement has a guide link guide assembly with precision positioning. In another further embodiment, an improvement consists of a crankshaft coupling assembly for coupling a first connection rod and a second connection rod to the crankshaft such that the reciprocating motion along the first and second longitudinal axes are substantially coplanar. The crankshaft coupling assembly may be a "fork and blade" type assembly.

In accordance with another aspect of the invention, another improvement is provided to a Stirling cycle engine. The improvement has a bearing mount coupled to at least one support bracket which is coupled to a pressure enclosure such that a dimensional change of the pressure enclosure is substantially decoupled from the bearing mount. In another embodiment, a method for aligning a piston in a cylinder, the piston undergoing reciprocating motion along a longitudinal axis and coupled to a guide link having a length, comprises providing a first guide element along the length of the guide link, the first guide element having a spring mechanism for urging the guide element into contact with the guide link and providing a second guide element along the length of the guide link, the second guide element in opposition to the first guide element and having a precision positioner for positioning the second guide element with respect to the longitudinal axis. In a preferred embodiment, the precision positioner is a vernier mechanism having an eccentric shaft for varying a distance between the second guide element and the longitudinal axis.

In another further embodiment, an alignment device is provided having a first guide element located along the length of the guide link, the first guide element having a spring mechanism for urging the guide element into contact with the guide link and a second guide element in opposition to the first guide element, the second guide element having a precision positioner for positioning the second guide element with respect to the longitudinal axis.

BRIEF DESCRIPTION OF THE DRAWINGS

The invention will be more readily understood by reference to the following description, taken with the accompanying drawings, in which.

DETAILED DESCRIPTION OF PREFERRED EMBODIMENTS

Figure 1C:
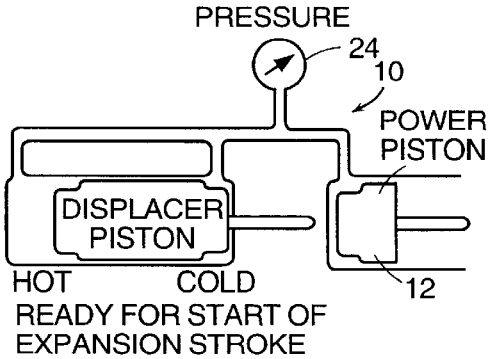
FIG. 1c PRIOR ART
FIGS 1*a*–1*e* depict the principle of operation of a prior art Stirling cycle machine.
Figure 1D:
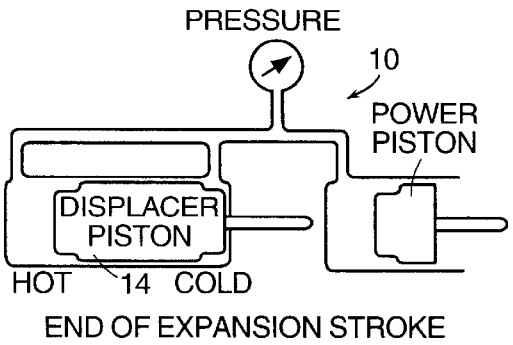
FIG. 1d PRIOR ART
Figure 1E:
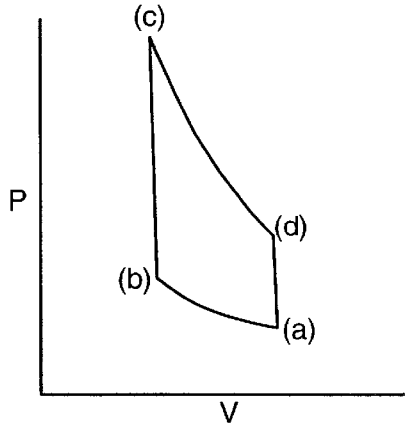
FIG. 1e PRIOR ART
Figure 1B:
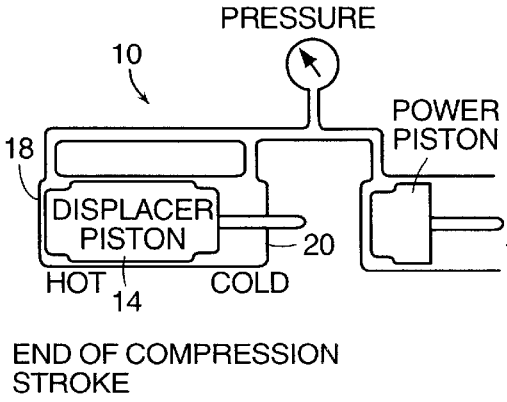
FIG. 1b PRIOR ART
Figure 1A:
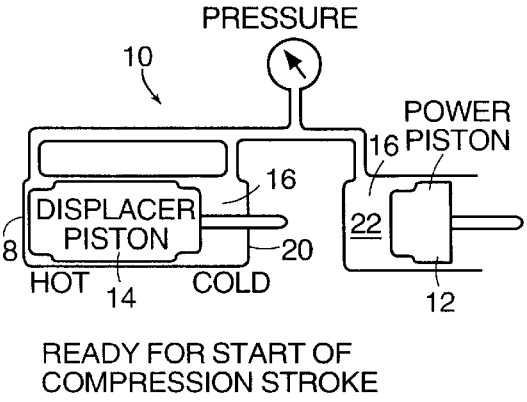
FIG. 1a PRIOR ART
Figure 2:
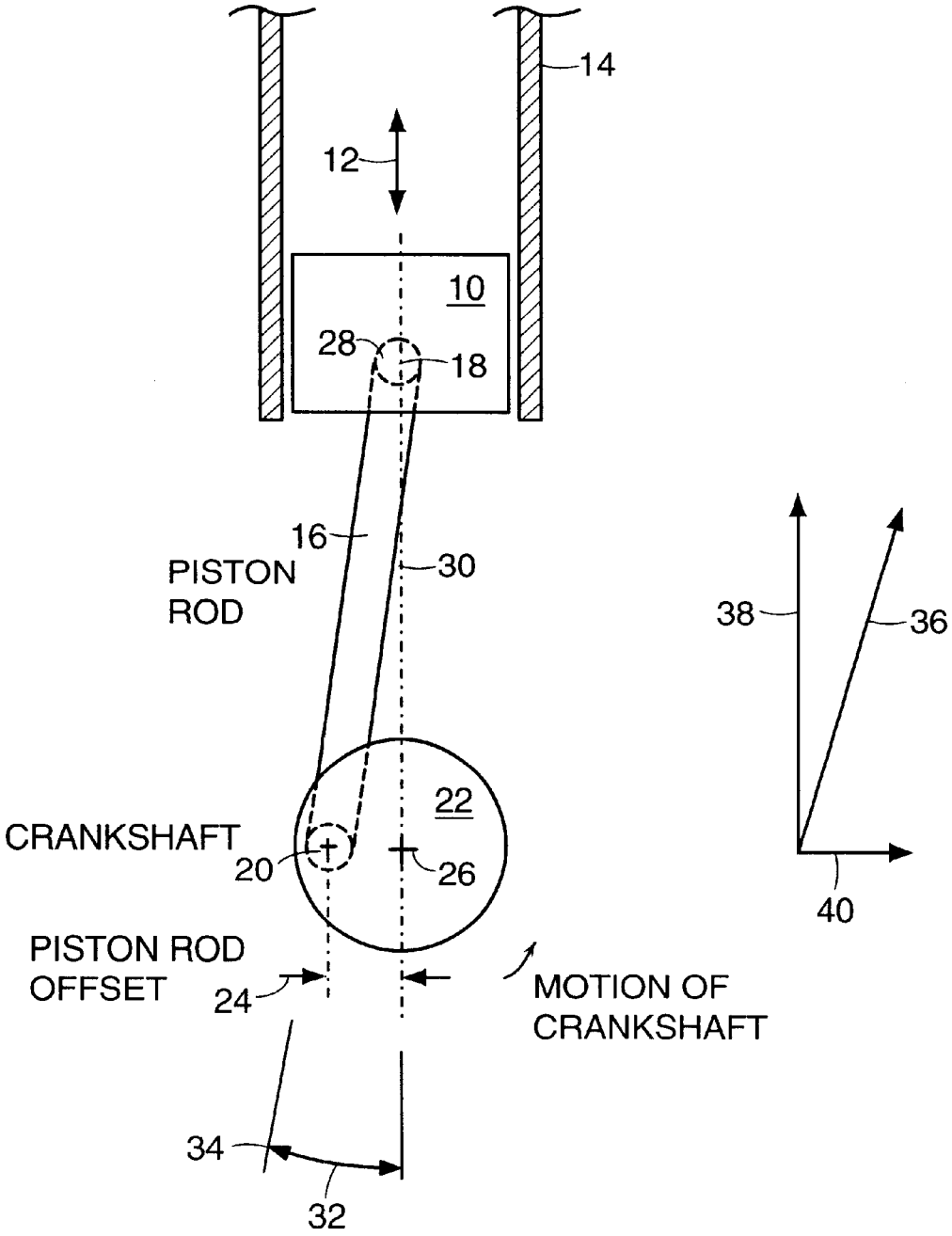
FIG. 2 PRIOR ART
FIG. 2 a cross-sectional view of a prior art linkage for an engine.
Figure 3:
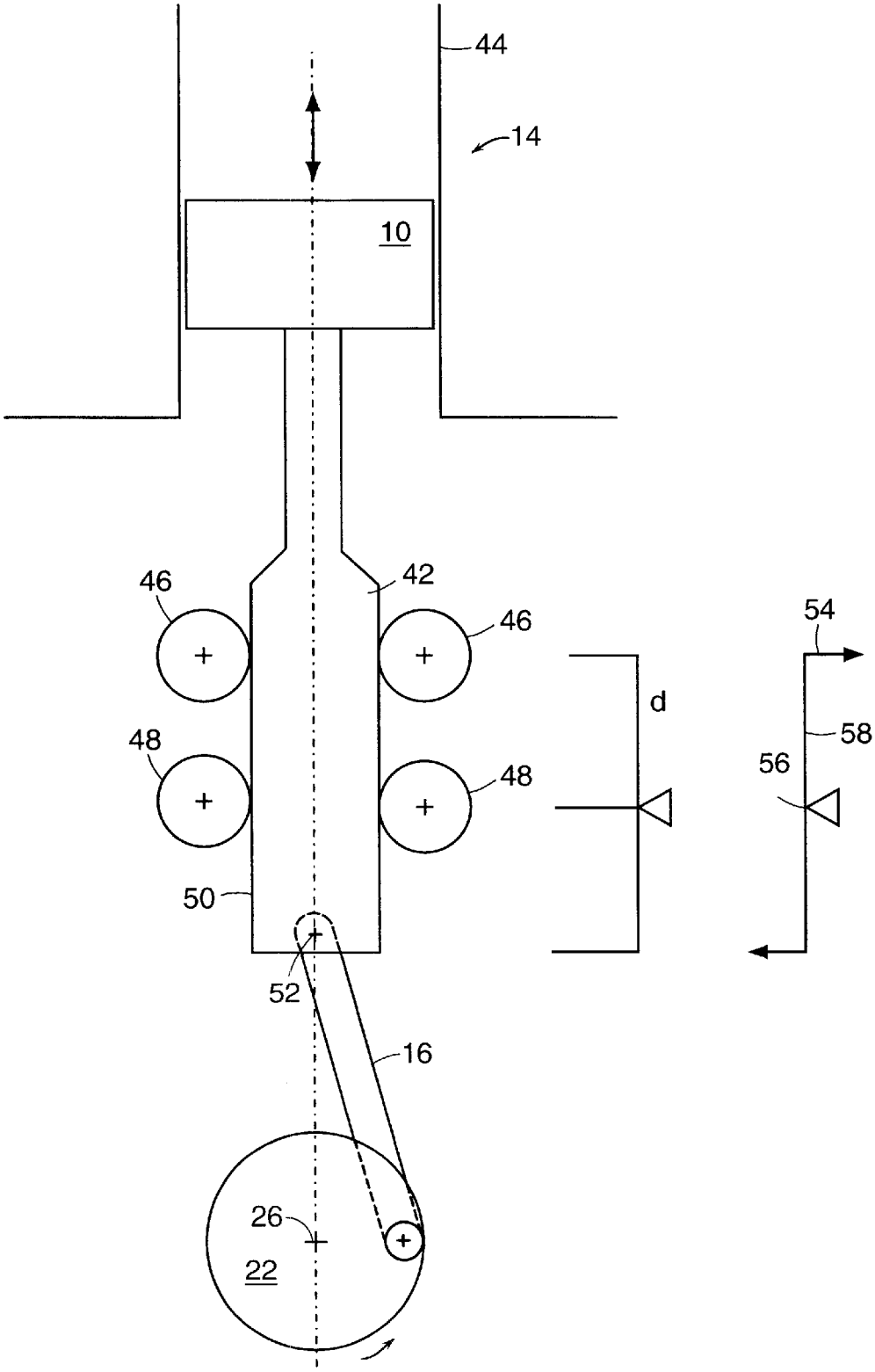
FIG. 3 PRIOR ART
FIG. 3 is a cross-sectional view of a second prior art linkage for an engine, the linkage having a guide link.
Figure 4:
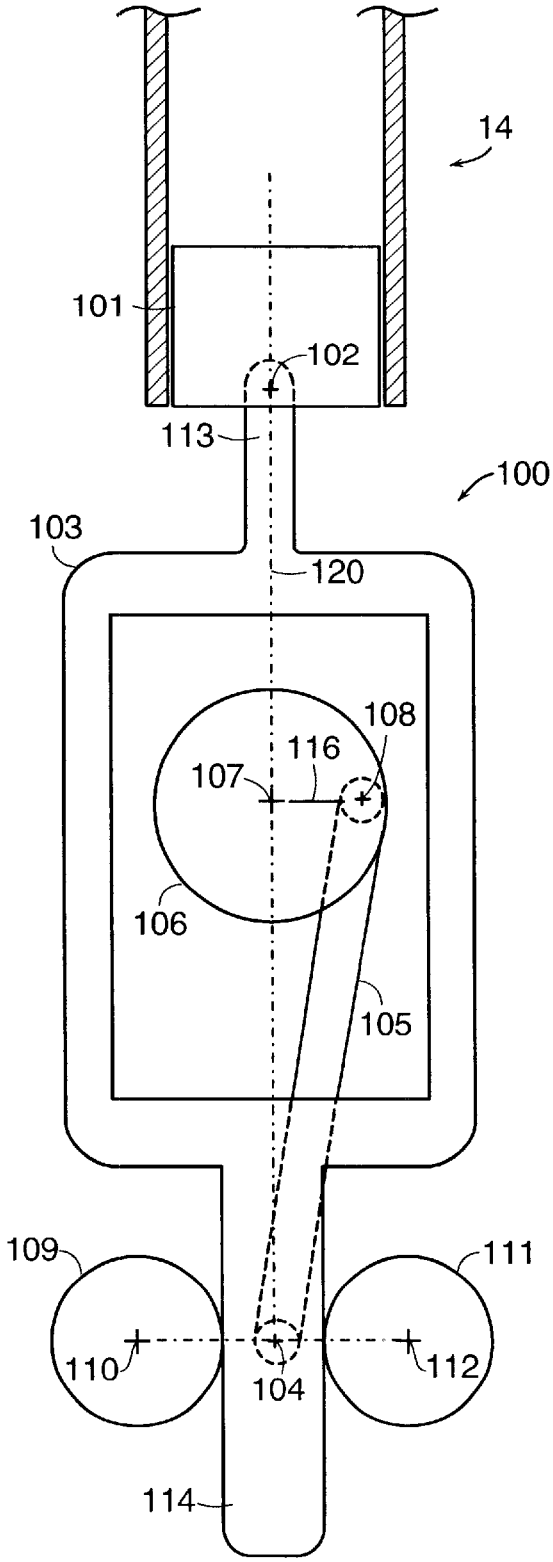
FIG. 4 is a cross-sectional view of a folded guide link linkage for an engine in accordance with a preferred embodiment of the present invention.

Referring now to FIG. 4, a schematic diagram is shown of a folded guide link linkage designated generally by numeral 100. A piston 101 is rigidly coupled to the piston end of a guide link 103 at a piston connection point 102. Guide link 103 is rotatably connected to a connecting rod 105 at a rod connection point 104. The piston connection point 102 and the rod connection point 104 define the longitudinal axis 120 of guide link 103.

Connecting rod 105 is rotatably connected to a crankshaft 106 at a crankshaft connection point 108 which is offset a fixed distance from the crankshaft axis of rotation 107. The crankshaft axis of rotation 107 is orthogonal to the longitudinal axis 120 of the guide link 103 and the crankshaft axis of rotation 107 is disposed between the rod connection point 104 and the piston connection point 102. In a preferred embodiment, the crankshaft axis of rotation 107 intersects the longitudinal axis 120.

An end 114 of guide link 103 is constrained between a first roller 109 and an opposing second roller 111. The centers of roller 109 and roller 111 are designated respectively by numerals 110 and 112. The position of guide link piston linkage 100 depicted in FIG. 4 is that of mid-stroke point in the cycle. This occurs when the radius 116 between the crankshaft connection point 108 and the crankshaft axis of rotation 107 is orthogonal to the plane defined by the crankshaft axis of rotation 107 and the longitudinal axis of the guide link 103. In a preferred embodiment, the rollers 109, 111 are placed with respect to the guide link 103 in such a manner that the rod connection point 104 is in the line defined by the centers 110, 112 of the rollers 109, 111 at mid-stroke. As rollers 109, 111 wear during use, the misalignment of the guide link will increase. In a preferred embodiment, the first roller 109 is spring loaded to maintain rolling contact with the guide link 103. In accordance with embodiments of the invention, guide link 103 may comprise subcomponents such that the portion 113 of the guide link proximal to the piston may be a lightweight material such as aluminum, whereas the "tail" portion 114 of the guide link distal to the piston may be a durable material such as steel to reduce wear due to friction at rollers 109 and 111.

Alignment of the longitudinal axis 120 of the guide link 103 with respect to piston cylinder 14 is maintained by the rollers 109, 111 and by the piston 101. As crankshaft 106 rotates about the crankshaft axis of rotation 107, the rod connection point 104 traces a linear path along the longitudinal axis 120 of the guide link 103. Piston 101 and guide link 103 form a lever with the piston 101 at one end of the lever and the rod end 114 of the guide link 103 at the other end of the lever. The fulcrum of the lever is on the line defined by the centers 110, 112 of the rollers 109, 111. The lever is loaded by a force applied at the rod connection point 104. As rod connection point 104 traces a path along the longitudinal axis of the guide link 103, the distance between the rod connection point 104 and the fulcrum, the first lever arm, will vary from zero to one-half the stroke distance of the piston 101. The second lever arm is the distance from the fulcrum to the piston 101. The lever ratio of the second lever arm to the first lever arm will always be greater than one, preferably in the range from 5 to 15. The lateral force at the piston 101 will be the forced applied at the rod connection point 104 scaled by the lever ratio; the larger the lever ratio, the smaller the lateral force at the piston 101.

By moving the connection point to the side of the crankshaft axis distal to that of the piston, the distance between the crankshaft axis and the piston cylinder does not have to be increased to accommodate the roller housing. Additionally, only one set of rollers is required for aligning the piston, thereby advantageously reducing the size of the roller housing and the overall size of the engine. In accordance with the invention, while the piston experiences a non-zero lateral force (unlike a standard guide link design where the lateral force of a perfectly aligned piston is zero), the lateral force can be at least an order of magnitude less than that experienced by a simple connecting rod crankshaft arrangement due to the large lever arm created by the guide link.

Figure 5A:
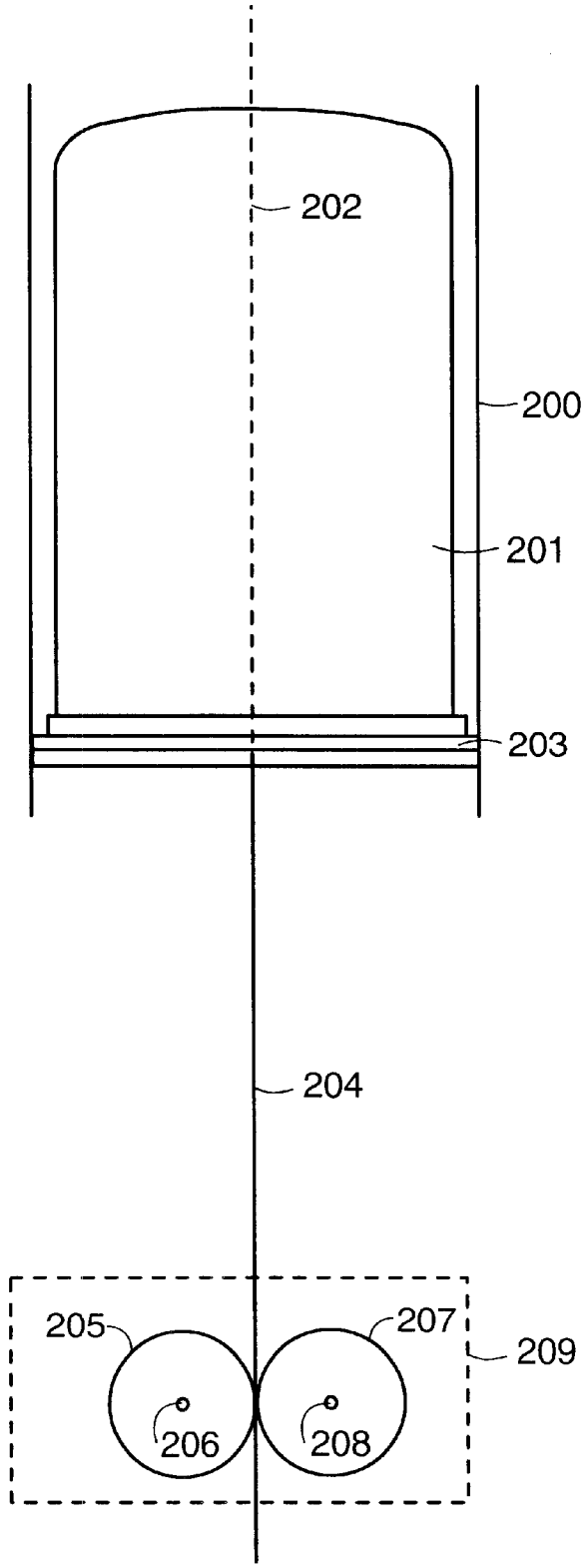
FIG. 5*a* is a cross-sectional view of a piston and guide assembly for allowing the precision alignment of piston motion using vernier alignment in accordance with a preferred embodiment of invention.

Lateral forces on a piston can give rise to noise and to wear. Additional friction may be generated by the misalignment of the piston in the cylinder. A solution to the alignment problem is now discussed with reference to FIGS. 5*a*–5*e*. FIG. 5*a* shows a schematic diagram of a piston 201 and a guide assembly 209 for allowing precision alignment of piston motion using vernier alignment in accordance with a preferred embodiment of the invention. The piston 201 executes a reciprocating motion along a longitudinal axis 202 in cylinder 200. A guide link 204 is coupled to the piston 201. An end of the guide link 204 is constrained between a first roller 205 and an opposing second roller 207. The centers of roller 205 and roller 207 are designated respectively by numerals 206 and 208. A piston guide ring 203 may be used at one end of the piston 201 to prevent piston 201 from touching the cylinder 200. However, if piston 201 is not aligned to move in a straight line along longitudinal axis 202, it is possible other points along the length of piston 201 not coupled to the guide ring may contact the cylinder 200. In a preferred embodiment, piston 201 is aligned using rollers 205 and 207 and guide link 204 such that piston 201 moves along the longitudinal axis 202 in a straight line and is substantially centered with respect to cylinder 200.

In accordance with a preferred embodiment of the invention, the piston 201 may be aligned with respect to the piston cylinder 200 by adjusting the position of the center 208 of the second roller 207. The first roller 205 is spring loaded to maintain rolling contact with the guide link 204. The second roller 207 is mounted on an eccentric flange such that rotation of the flange causes the second roller 207 to move laterally with respect to longitudinal axis 202. A single pin (not shown) may be used to secure the second roller 207 into a position. The movement of the second roller 207 will cause the guide link 204 and the piston 201 to also move laterally with respect to the longitudinal axis 202. In this manner, the piston 201 may be aligned so as to move in cylinder 200 in a straight line which is substantially centered with respect to cylinder 200.

Figure 5B:
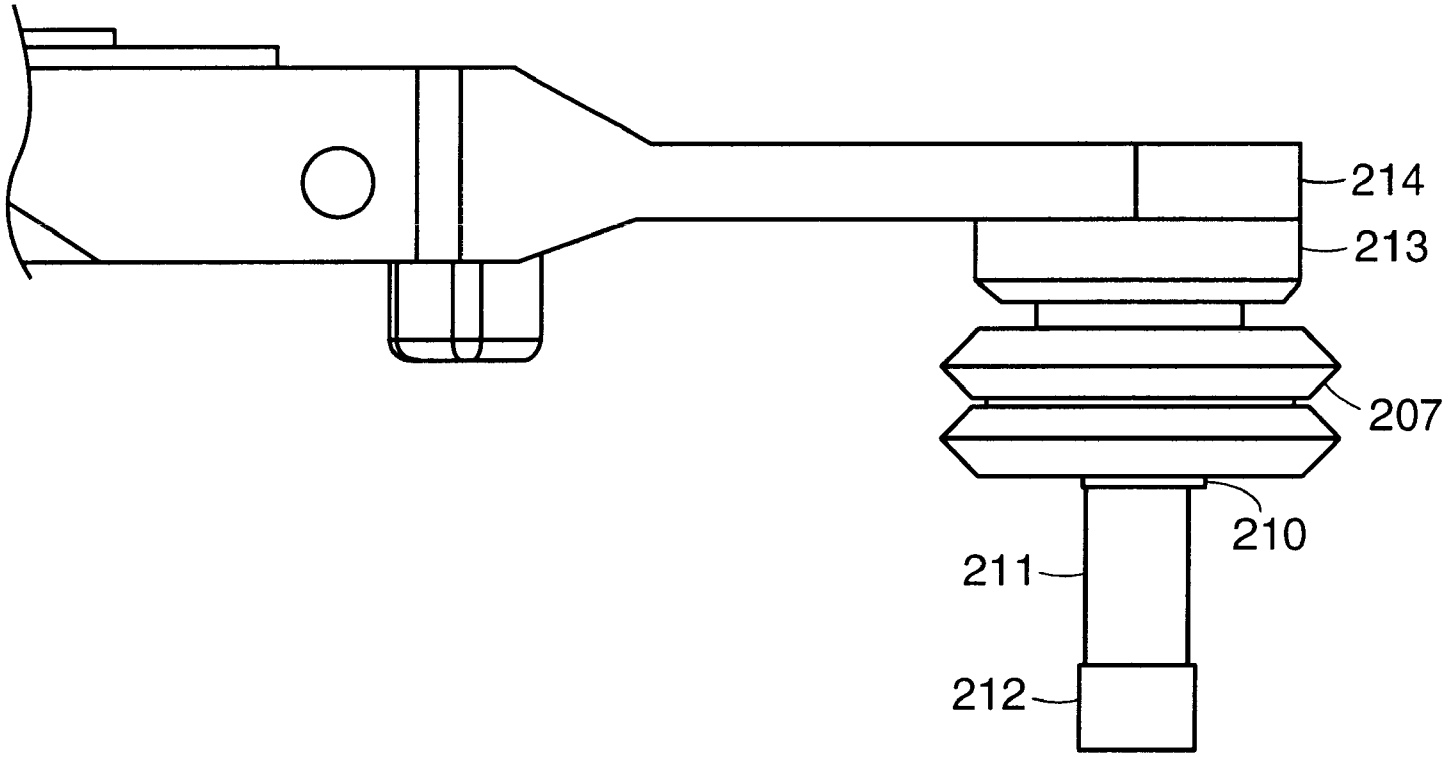
FIG 5*b* is a side view of the precision alignment mechanism in accordance with an embodiment of invention.
Figure 5C:
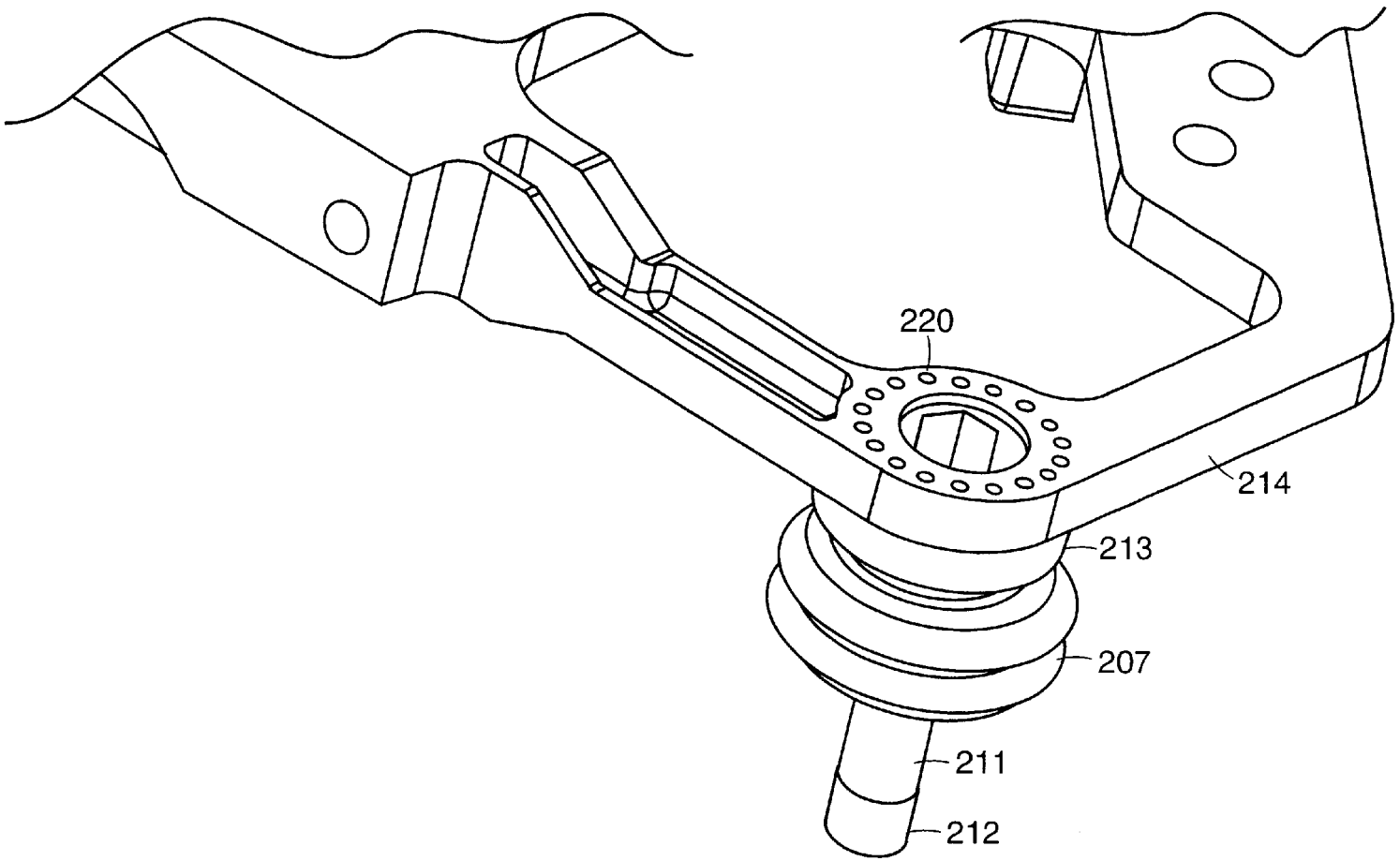
FIG 5*c* is a perspective view of the precision alignment mechanism of FIG. 5*b* in accordance with embodiment of the invention.

FIG. 5*b* shows a side view of one embodiment of a precision alignment mechanism. A roller 207 is rotatably mounted on a locking eccentric 211 having a lower end 212 and an upper end 213. The roller is mounted on a portion 210 of the locking eccentric 211 having a roller axis of rotation that is offset from the axis of rotation of the locking eccentric 211. The lower end 212 is rotatably mounted in a lower bracket (not shown). The upper end 213 is rotatably mounted on an upper bracket 214. FIG. 5*c* shows a perspective view of the embodiment shown in FIG. 5*b*. The upper bracket 214 has a plurality of bracket holes 220 drilled through the upper bracket 214. In a preferred embodiment, eighteen bracket holes are drilled through the upper bracket 214. The bracket holes 220 are offset a distance from the axis of rotation of the locking eccentric 211 and are evenly spaced around the circumference defined by the offset distance.

Figure 5D:
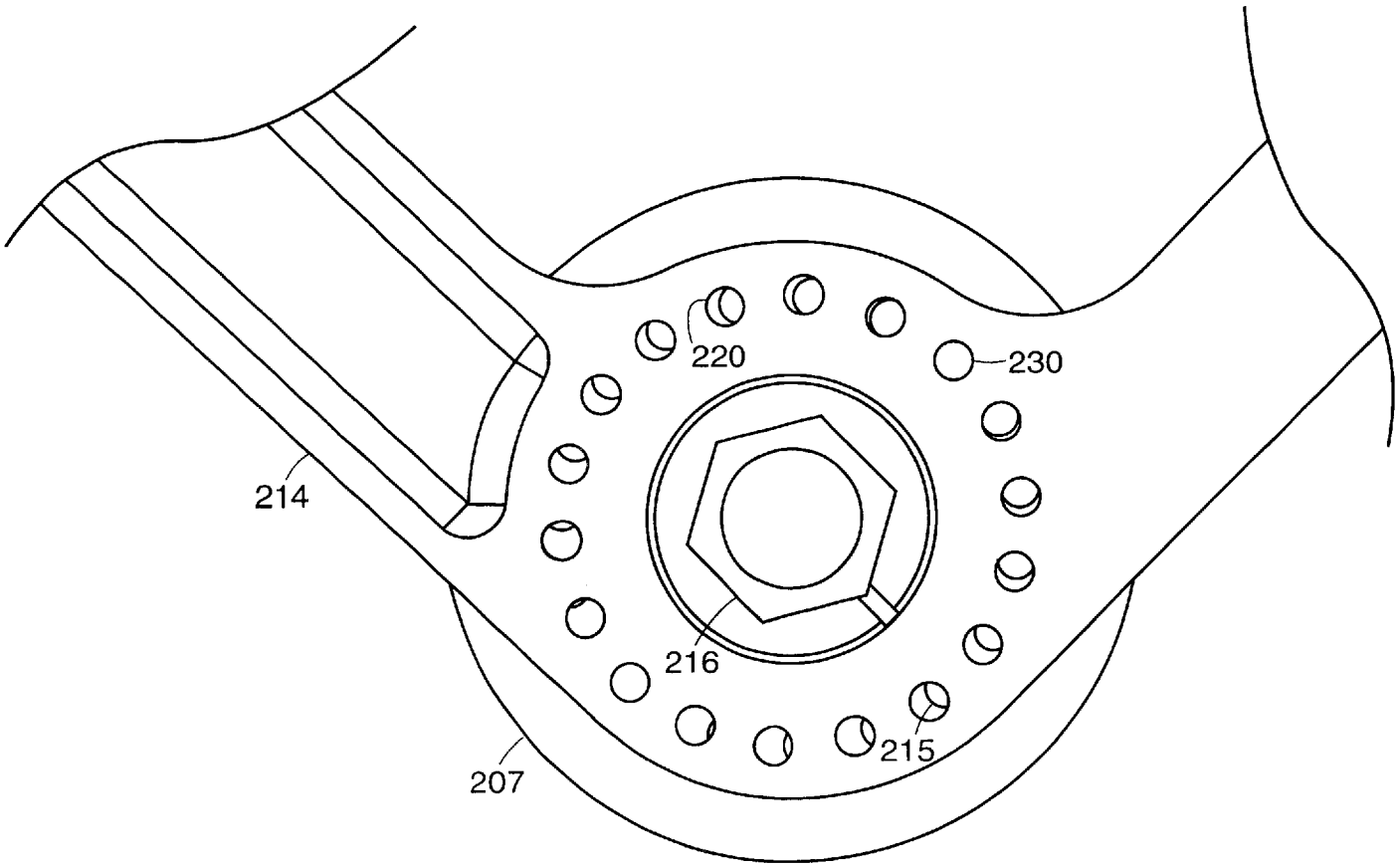
FIG. 5*d* is a top view of the precision alignment mechanism of FIG. 5*b* in accordance with an embodiment of the invention.
Figure 5E:
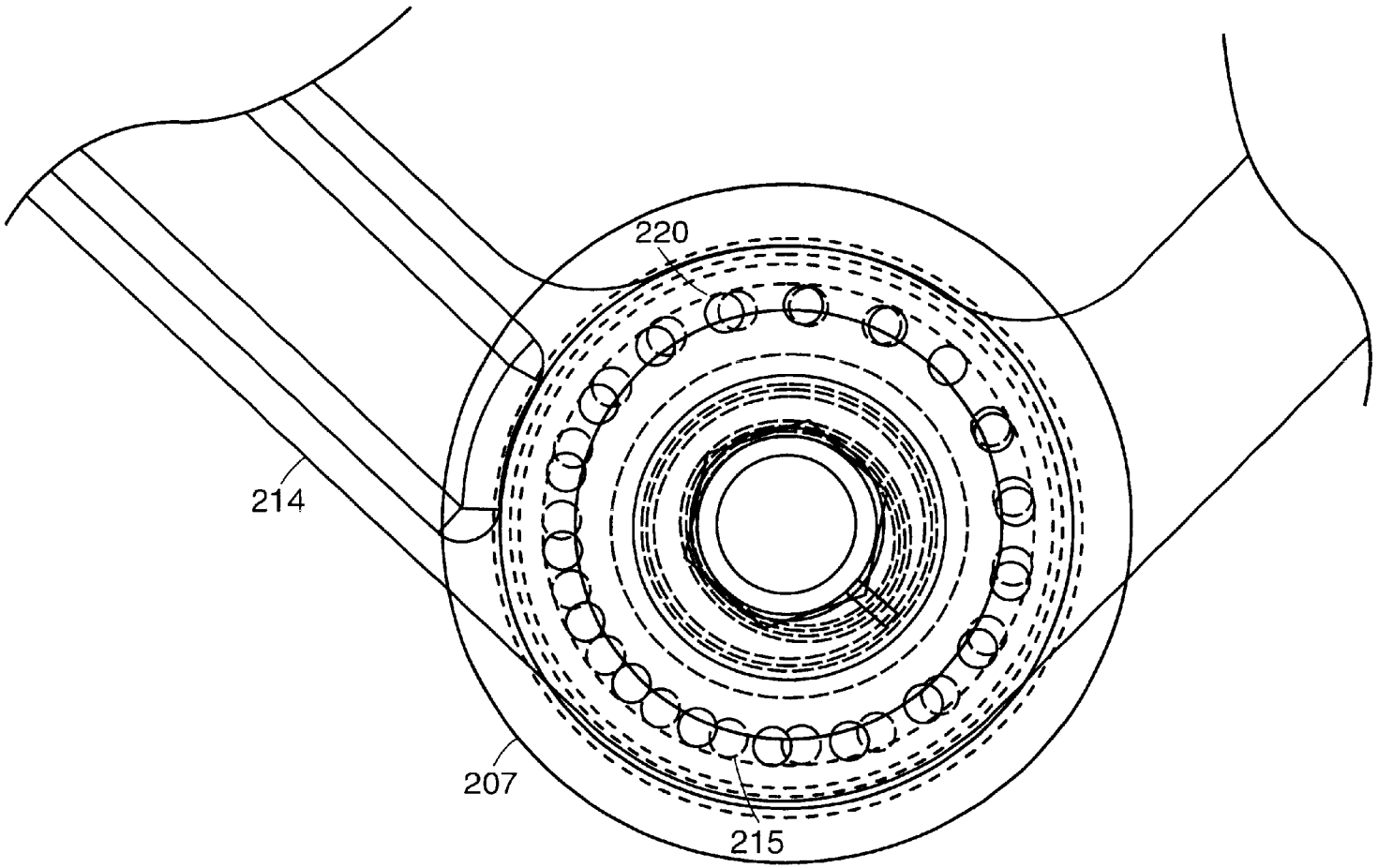
FIG. 5*e* is a top view of the precision alignment mechanism of FIG. 5*b* with both the locking holes and the bracket holes showing in accordance with an embodiment of the invention.

FIG. 5*d* shows a the top view of the embodiment shown in FIG. 5*b*. The upper end 213 of the locking eccentric 211 has a plurality of locking holes 215. The number of locking holes 215 should not be identical to the number of bracket holes 220. In a preferred embodiment, the number of locking holes 215 is nineteen. The locking holes 215 are offset from the axis of rotation of the locking eccentric 211 by the same distance used to offset the bracket holes 220. The locking holes 215 are evenly spaced around the circumference defined by the offset distance. FIG. 5*d* also shows a locking nut 216 that allows the locking eccentric 211 to rotate when the locking nut 216 is loose. When the locking nut 216 is tightened, the locking nut 216 makes a rigid connection between the locking eccentric 211 and the upper bracket 214. FIG. 5*e* is the same view as shown in FIG 5*d* but with the locking holes 215 shown.

During assembly, the piston is aligned in the following manner. The folded guide link is assembled with the locking nut 216 in a loosened state. The piston 201 (FIG. 5*a*) is aligned within the piston cylinder 200 (FIG. 5*a*) visually by rotating the locking eccentric 211. As the locking eccentric 211 is rotated, the roller axis of rotation 208 (FIG. 5*a*) will be displaced both laterally and longitudinally to the guide link longitudinal axis 202 (FIG. 5*a*). The large lever ratio of the present invention requires only a very small displacement of the roller axis of rotation 208 (FIG. 5*a*) with respect to the longitudinal axis 202 (FIG. 5*a*) to align the piston 201 (FIG. 5*a*) within the piston cylinder 200 (FIG. 5*a*). In accordance with an embodiment of the invention, the maximum displacement range may be from 0.000 inches to 0.050 inches. In a preferred embodiment, the maximum displacement is between 0.010 inches and 0.030 inches. As the locking eccentric 211 is rotated, the locking holes 215 will align with a bracket hole 220. FIG. 5*d* indicates such an alignment 230. Once the piston 201 (FIG. 5*a*) is aligned in the piston cylinder 200 (FIG. 5*a*), a pin (not shown) is inserted through the aligned bracket hole and into the aligned locking hole thereby locking the locking eccentric 211. The locking nut 216 is then tightened to rigidly connect the upper bracket 214 to the locking eccentric 211.

Figure 6:
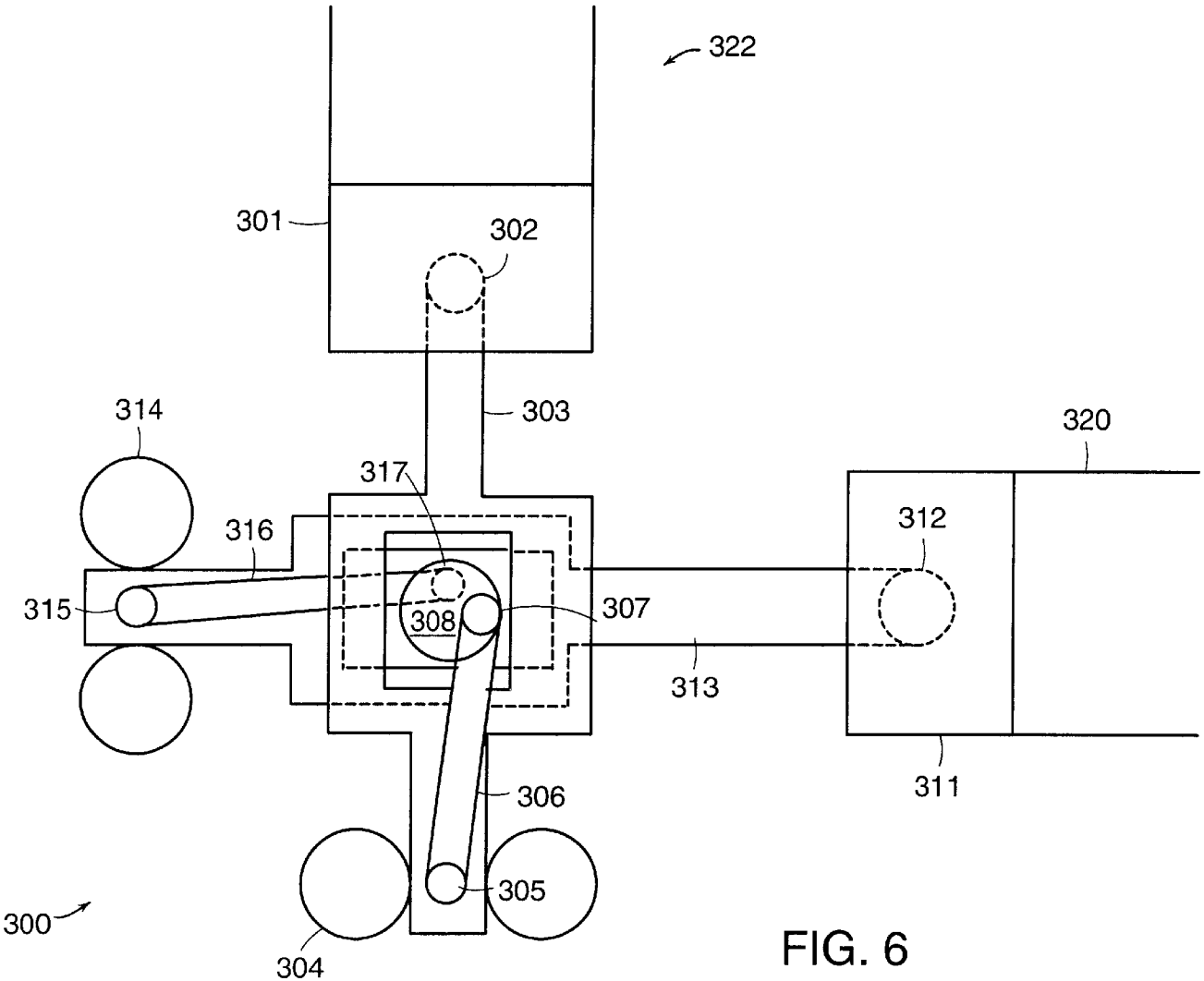
FIG. 6 is a cross-sectional view of a folded guide link linkage for a two-piston machine such as a Stirling cycle machine in accordance with a preferred embodiment of the present invention.

In accordance with a preferred embodiment of the invention, a dual folded guide link piston linkage such as shown in cross-section in FIG. 6 and designated there generally by numeral 300 may be incorporated into a compact Stirling engine. Referring now to FIG. 6, pistons 301 and 311 are the displacer and compression pistons, respectively, of a Stirling cycle engine. As used in this description and the following claims, a displacer piston is either a piston without a seal or a piston with a seal (commonly known as an "expansion" piston). The Stirling cycle is based on two pistons executing reciprocating linear motion about 90° out of phase with one another. This phasing is achieved when the pistons are oriented at right angles and the respective connecting rods share a common pin of a crankshaft. Additional advantages of this orientation include reduction of vibration and noise. Additionally, the two pistons may advantageously lie in the same plane to eliminate shaking vibrations orthogonal to the plane of the pistons. In accordance with a preferred embodiment, a "fork and blade" type crankshaft coupling assembly, as described below, is used to couple the connecting rods 306 and 316 to the crankshaft 308 at crankshaft connection points 307 and 317 respectively so that the pistons 301 and 311 may move in the same plane.

Figure 7:
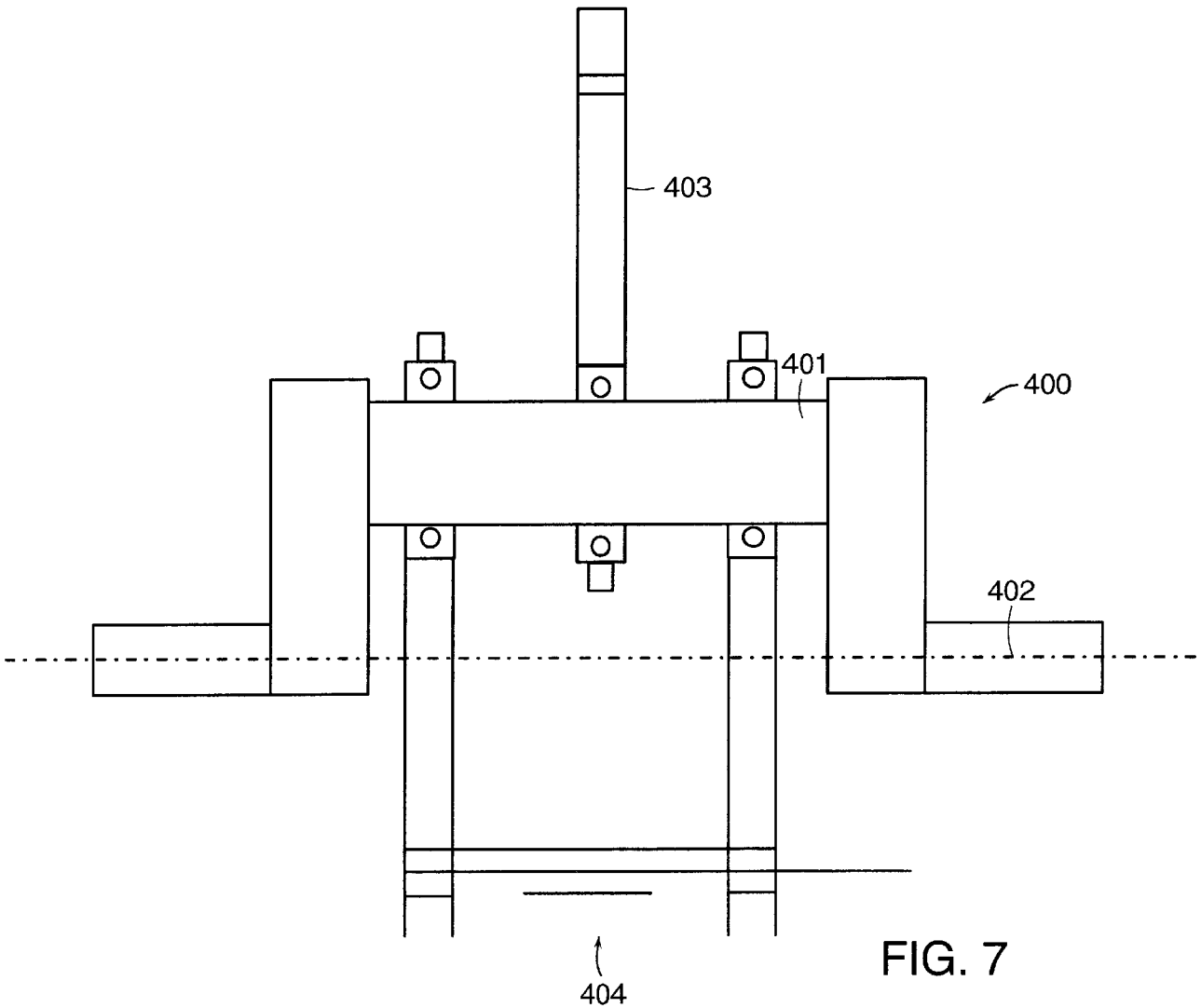
FIG. 7 is a cross-sectional view of a "fork-and blade" type crankshaft coupling assembly in accordance with a preferred embodiment of the invention.

FIG. 7 is a cross-sectional view of a "fork and blade" type coupling assembly. A crankshaft 400 has a crankshaft pin 401. The crankshaft pin 401 rotates about the crankshaft axis of rotation 402. A first coupling element 403 is a "blade" link. In other words, as seen in FIG. 7, the "blade" is a single link used to couple a first connecting rod to the crankshaft pin 401. A second coupling element 404 includes a "fork" link. The "fork", as seen in FIG. 7, is a pair of links used to couple a second connecting rod to the crankshaft pin 401. The first and second coupling elements 403 and 404 may be used to couple two connecting rods to the same crankshaft pin such that the motion of the connecting rods is substantially within the same plane. Referring again to FIG. 6, a "fork and blade" type crankshaft coupling assembly, as shown in FIG. 7, may be used to connect the first coupling rod 306 and the second coupling rod 316 to the crankshaft 308 at crankshaft connection points 307 and 317 respectively. While the invention is described generally with reference to the Stirling engine shown in FIG. 6, it is to be understood that many engines as well as refrigerators may similarly benefit from various embodiments and improvements which are subjects of the present invention.

Figure 8:
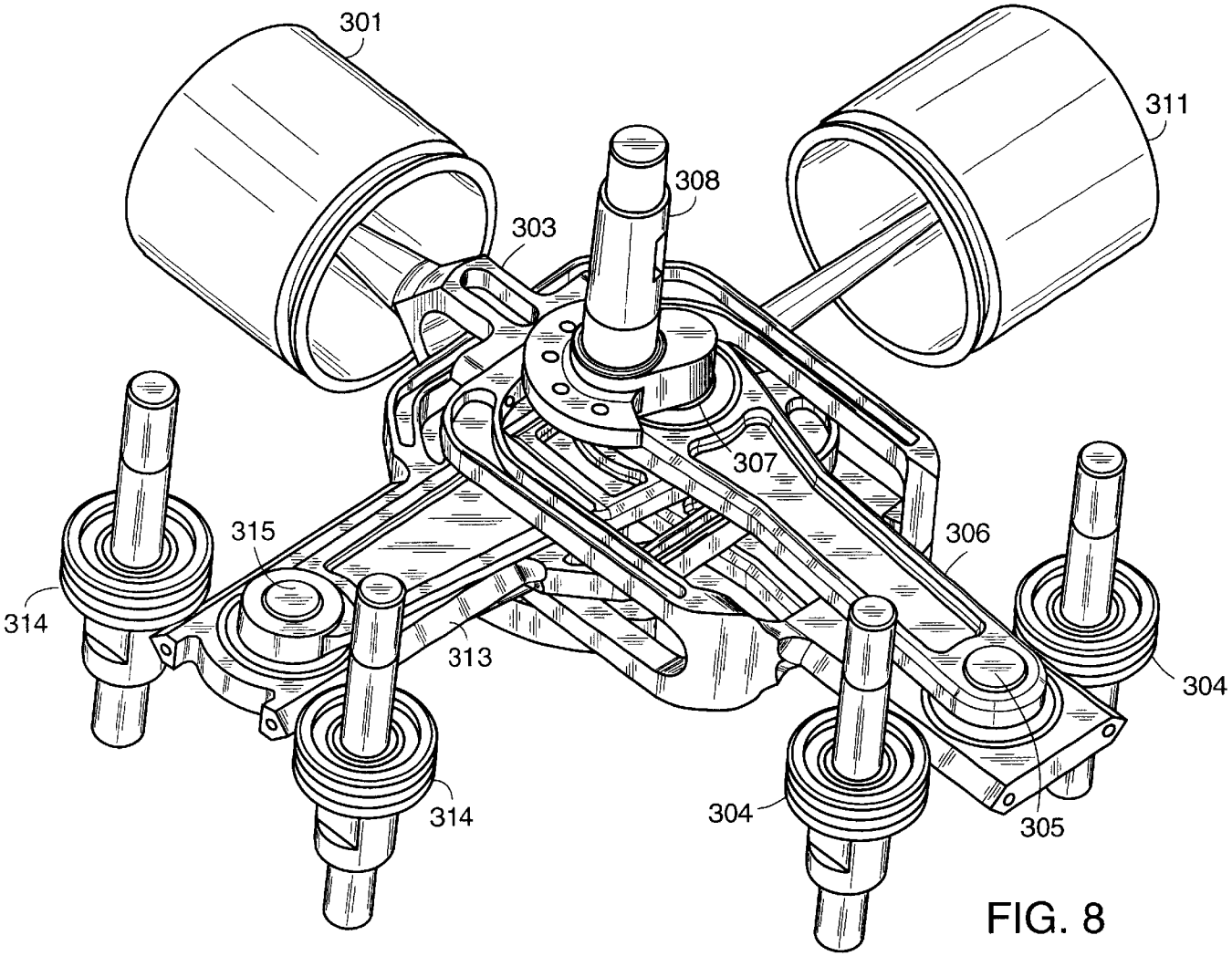
FIG. 8 is a perspective view of one embodiment of the dual folded guide link linkage of FIG. 6.

The configuration of a Stirling engine shown in FIG. 6 in cross-section, and in perspective in FIG. 8, is referred to as an alpha configuration, characterized in that compression piston 311 and displacer piston 301 undergo linear motion within respective and distinct cylinders: compression piston 311 in compression cylinder 320 and displacer piston 301 in expansion cylinder 322. Guide link 303 and guide link 313 are rigidly coupled to displacer piston 301 and compression piston 311 at piston connection points 302 and 312 respectively. Connecting rods 306 and 316 are rotationally coupled at connection points 305 and 315 of the distal ends of guide links 303 and 313 to crankshaft 308 at crankshaft connection points 307 and 317. Lateral loads on guide links 303 and 313 are taken up by roller pairs 304 and 314. As discussed above with respect to FIGS. 4 and 5, the pistons 301 and 311 may be aligned within the cylinders 320 and 322 respectively such using precision alignment of roller pairs 304 and 314.

As described above with respect to FIGS. 1*a*–1*f*, a Stirling engine operates under pressurized conditions. Typically, a crankcase is used to support the crankshaft and maintain the pressurized conditions under which the Stirling engine operates. The crankshaft would be supported at both ends by crankshaft bearing mounts which would be mounted in the crankcase itself. As the crankcase is pressurized, however, the dimensions of the crankcase may change or deform. If the same structure is used to support the crankshaft, the deformation of the crankcase may result in a misalignment of the crankshaft which places a tremendous burden on the bearings and significantly reduces the lifetime of the engine. In order to reduce or prevent the misalignment of the crankshaft caused by the deformation of the crankcase, the support function of the crankcase may be separated from the pressure function of the crankcase as shown in FIG. 9*a*.

Figure 9A:
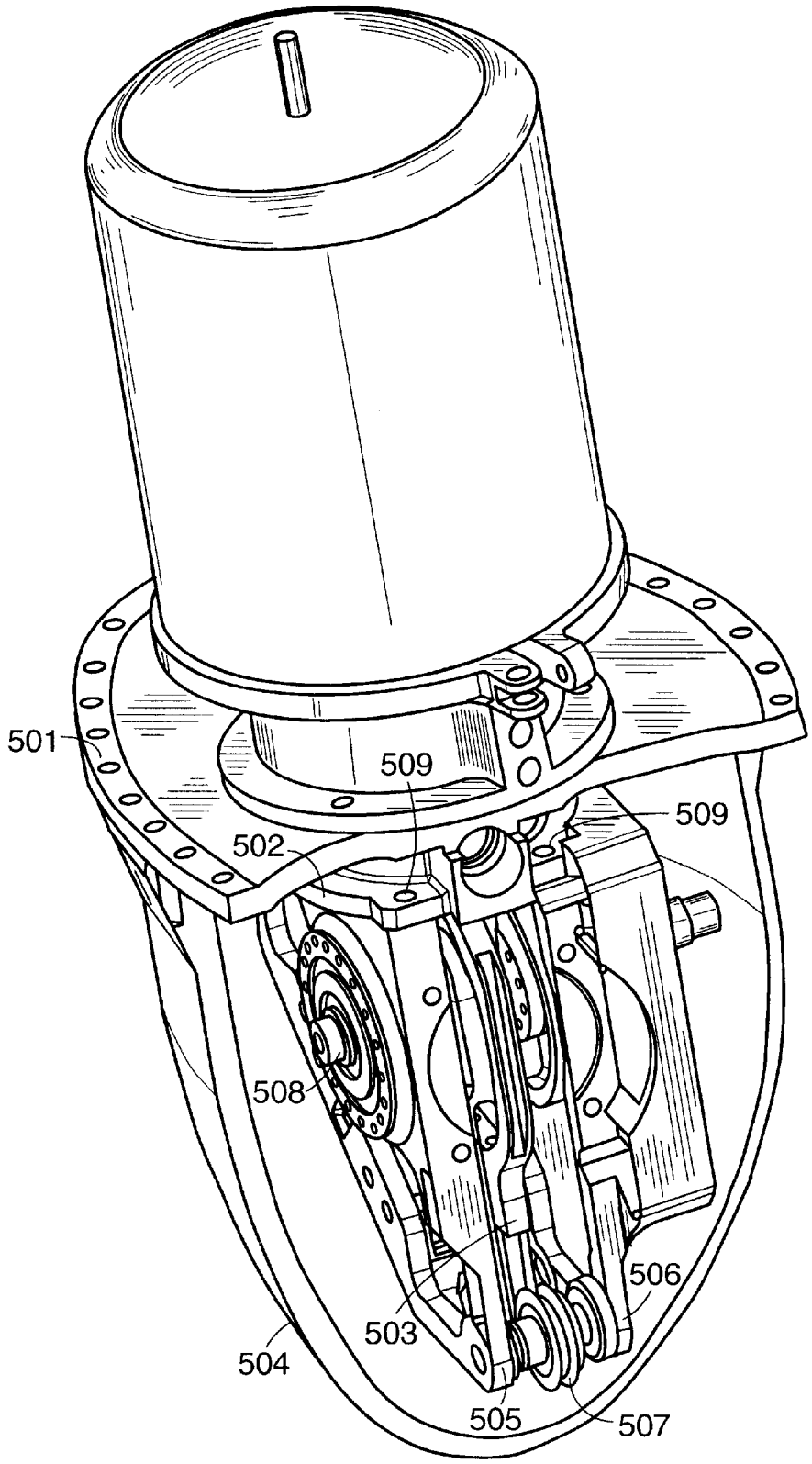
FIG. 9*a* is a perspective view of a Stirling engine in accordance with a preferred embodiment of the invention.

FIG. 9*a* is a perspective view of a Stirling engine in accordance with a preferred embodiment of the invention. A piston guide link 503 and roller 507 assembly is shown as described with respect to FIGS. 4, 7 and 8. A cold section base plate 501 is coupled to a pressure enclosure 504 to form a crankcase and to define a pressurized volume. An upper bracket 506 and a lower bracket 505 are attached to the cold section base plate 501 using bracket mounting holes 509 on the bracket base mount 502 of the cold section base plate 501. In a preferred embodiment, the upper bracket 506 and the lower bracket 505 are attached to the cold section base plate 501 using screws. A crankshaft 508 is supported on both ends by crankshaft bearing mounts (not shown). The crankshaft bearing mounts are mounted on the upper bracket 506 and the lower bracket 505. In this manner, the bearing mounts are advantageously not directly mounted on the crankcase. The roller 507 is also coupled to the upper bracket 506 and the lower bracket 505 as described with respect to FIGS. 5*a*–5*e*.

Figure 9B:
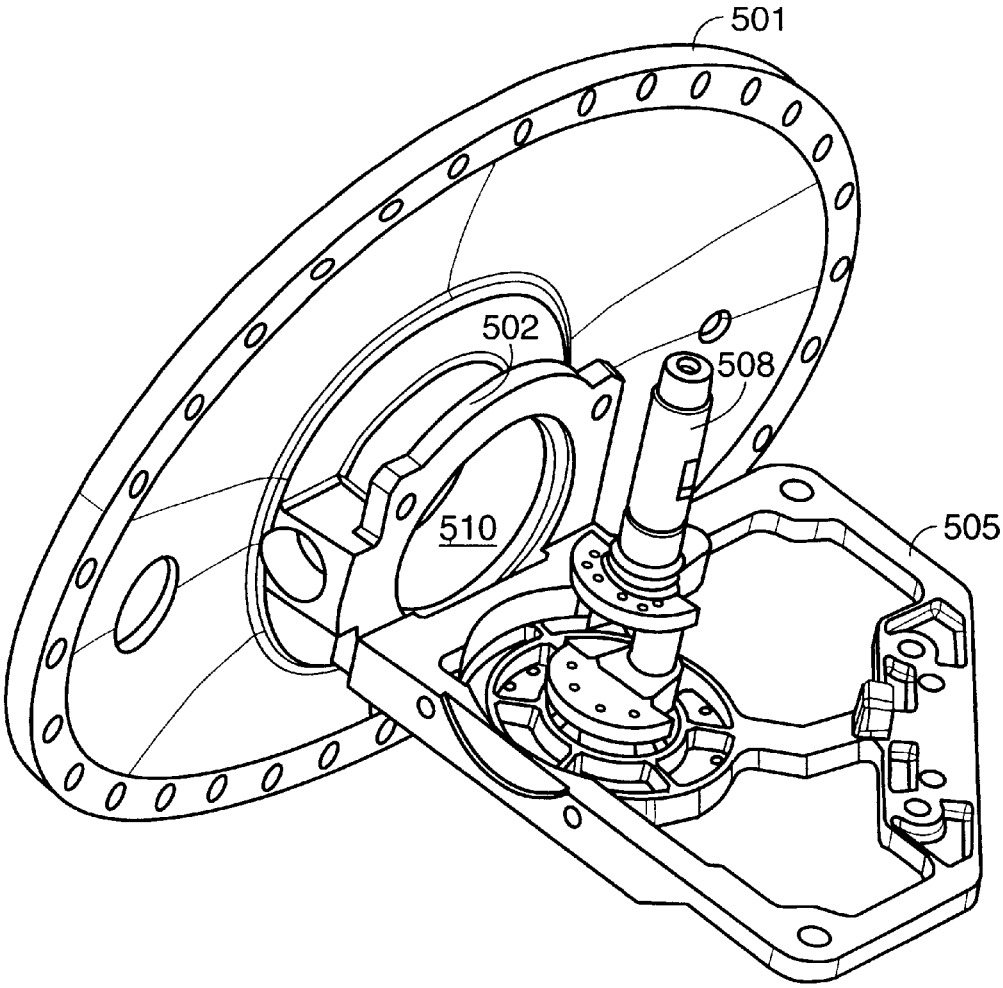
FIG. 9*b* is a perspective view of the cold section base plate and the lower bracket of FIG. 9*a* where the lower bracket is mounted on the cold section base plate in accordance with a preferred embodiment of the invention.

FIG. 9*b* is a perspective view of the cold section base plate 501 coupled to the lower bracket 505 of FIG. 9*a*. The crankshaft 508 is connected to the lower bracket 505. The lower bracket 505 is mounted on the cold section base plate 501. An opening 510 in the cold section base plate 501 is provided for a piston and a cylinder. As described above, in a preferred embodiment, the crankshaft 508 is supported by crankshaft bearing mounts (not shown) at both ends. The bearing mounts are then mounted on the upper 506 and lower 505 brackets. This configuration advantageously decouples the deformation of the crankcase caused by the pressurized operating conditions of the Stirling engine from the engine alignment. While the crankcase will still deform under high pressure, the deformation will not affect the alignment of the crankshaft because the crankshaft is not directly mounted on the crankcase. This configuration also advantageously reduces the bearing loads by shortening the distance between the bearing mounts (the distance between the upper and lower brackets instead of the distance between the opposite faces of the crankcase). In a preferred embodiment, the region of the cold base plate may also be locally reinforced to further reduce the local deformation of the bracket mount due to the pressurized operating conditions.

The devices and methods described herein may be applied in other applications besides the Stirling engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

We claim:

1. A linkage for coupling a piston undergoing reciprocating linear motion along a longitudinal axis to a crankshaft undergoing rotary motion about a rotation axis of the crankshaft, the longitudinal axis and the rotation axis being substantially orthogonal to each other, the linkage comprising:

a guide link having a first end proximal to the piston, the first end coupled to the piston, and having a second end distal to the piston such that the rotation axis is disposed between the proximal end and the distal end of the guide link;

a guide link guide assembly for supporting lateral loads at the distal end of the guide link, the guide link guide assembly having a first roller, the first roller having a center of rotation fixed with respect to the rotation axis of the crankshaft and a rim in rolling contact with the distal end of the guide link; and a connecting rod having a connecting end and a crankshaft end, the connecting end rotatably connected to the end of the guide link distal to the piston at a rod connection point that traverses the guide link guide assembly during the course of reciprocating linear motion of the piston and the crankshaft end coupled to the crankshaft at a crankshaft connection point offset from the rotation axis of the crankshaft.

2. A linkage according to claim 1, wherein the guide link guide assembly further includes a spring mechanism for urging the rim of the first roller into contact with the distal end of the guide link.

3. A linkage according to claim 2, wherein the guide link guide assembly further includes a second roller in opposition to the first roller, the second roller having a center of rotation and a rim in rolling contact with the distal end of the guide link.

4. A linkage according to claim 3, wherein the second roller further includes a precision positioner to position the center of rotation of the second roller with respect to the longitudinal axis.

5. A linkage according to claim 4, wherein the precision positioner is a vernier mechanism having an eccentric shaft for varying the distance between the center of rotation of the second roller and the longitudinal axis.

6. A linkage according to claim 3, wherein a line defined by the centers of the first and second rollers includes the rod connection point when the crankshaft connection point is at a mid-stroke position.

7. A machine comprising:

a piston having a longitudinal travel axis and undergoing reciprocating linear motion along the longitudinal travel axis;

a crankshaft capable of rotation about a rotation axis, the rotation axis being substantially orthogonal to the longitudinal axis;

a guide link having a length and a first end proximal to the piston, the first end coupled to the piston, the guide link having a second end distal to the piston such that the rotation axis is disposed between the proximal end and the distal end of the guide link, the guide link constrained to follow a substantially linear path at a discrete number of points along its length; and a connecting rod having a connecting end and a crankshaft end, the connecting end rotatably connected to the end of the guide link distal to the piston at a rod connection point that traverses the discrete number of points constraining the guide link during the reciprocating linear motion of the piston and the crankshaft end coupled to the crankshaft at a crankshaft connection point offset from the rotation axis of the crankshaft.

8. A guide link for coupling a piston undergoing reciprocating linear motion along a longitudinal axis to a crankshaft undergoing rotary motion about a rotation axis of the crankshaft, the longitudinal axis and the rotation axis being substantially orthogonal to each other, the guide link comprising:

a first end proximal to the piston, the first end coupled to the piston;

a second end distal to the piston and coupled to the crankshaft at a point displaced from the rotation axis such that the rotation axis is disposed between the first end and the second end of the guide link;

at least one support point at the second end of the guide link distal to the piston, the at least one support point for supporting lateral loads using a guide assembly; and a rod connection point for coupling a connecting rod at the second end of the guide link distal to the piston, the rod connection point traversing the guide assembly during the reciprocating linear motion of the piston.

9. A guide link according to claim 8, further including a coupling for connecting the first end to the second end such that the first end may be decoupled from the second end for replacement of a worn second end.

10. In a Stirling cycle machine of the type wherein a displacer piston undergoes reciprocating motion along a first longitudinal axis and a compression piston undergoes reciprocating motion along a second longitudinal axis, the improvement comprising:

a crankshaft undergoing rotary motion about a rotation axis of the crankshaft for coupling mechanical energy with respect to the machine;

a first and a second guide link, the first guide link having a first end proximal to the displacer piston and coupled to the displacer piston, the second guide link having a first end proximal to the compression piston and coupled to the compression piston, each guide link having a second end distal to the respective piston such that each rotation axis is disposed between the proximal end of the respective guide link and the distal end of the respective guide link;

two guide link guide assemblies, each guide link guide assembly in contact with the distal end of one of the guide links and for supporting lateral loads at the distal ends of the guide links; and two connecting rods, each connecting rod having a connecting end and a crankshaft end, the connecting end rotatably connected to the end of one of the guide links distal to the respective piston at a rod connection point that traverses the respective guide link guide assembly during the course of reciprocating linear motion of the respective piston and the crankshaft end coupled to the crankshaft at a crankshaft connection point offset from the rotation axis of the crankshaft.

11. In the Stirling cycle machine of claim 10, the improvement wherein each guide link guide assembly further includes a first roller, the first roller having a center of rotation fixed with respect to the rotation axis of the crankshaft and having a rim in contact with the distal end of the respective guide link.

12. In the Stirling cycle machine of claim 11, the improvement wherein each guide link guide assembly further includes a spring mechanism for urging the rim of the first roller into contact with the distal end of the respective guide link.

13. In the Stirling cycle engine of claim 12, the improvement wherein each guide link guide assembly further includes a second roller in opposition to the first roller, the second roller having a center of rotation and a rim in rolling contact with the distal end of the guide link.

14. In the Stirling cycle engine of claim 13, the improvement wherein at least one of the second rollers includes a precision positioner to position the center of rotation of the at least one second roller with respect to the respective longitudinal axis.

15. In the Stirling cycle machine of claim 14, the improvement wherein the precision positioner is a vernier mechanism having an eccentric shaft for varying a distance between the center of rotation of the second roller and the respective longitudinal axis.

16. In the Stirling cycle machine of claim 10, the improvement wherein the first and second longitudinal axes are substantially coplanar.

17. In a Stirling cycle machine of the type wherein a displacer piston undergoes reciprocating motion along a first longitudinal axis and a compression piston undergoes reciprocating motion along a second longitudinal axis, the improvement comprising:

a crankshaft undergoing rotary motion about a rotation axis of the crankshaft for coupling mechanical energy with respect to the machine;

a first and second guide link, the first guide link having a first end proximal to the displacer piston and coupled to the displacer piston, the second guide link having a first end proximal to the compression piston and coupled to the compression piston, each guide link having a second end distal to the respective piston such that each rotation axis is disposed between the proximal end of the respective guide link and the distal end of the respective guide link;

two guide link guide assemblies, each guide link guide assembly in contact with the distal end of one of the guide links and for supporting lateral loads at the distal ends of the guide links;

a first connecting rod, the first connecting rod having a connecting end and a crankshaft end, the connecting end rotatably connected to the end of the first guide link distal to the displacer piston at a rod connection point that traverses the respective guide link guide assembly during the course of reciprocating linear motion of the displacer piston and the crankshaft end coupled to the crankshaft at a first crankshaft connection point offset from the rotation axis of the crankshaft;

a second connecting rod, the second connecting rod having a connecting end and a crankshaft end, the connecting end rotatably connected to the end of the second guide link distal to the compression piston at a rod connection point that traverses the respective guide link guide assembly during the course of reciprocating linear motion of the compression piston and the crankshaft end coupled to the crankshaft at a second crankshaft connection point offset from the rotation axis of the crankshaft; and a crankshaft coupling assembly for coupling the first connection rod and the second connection rod to the crankshaft such that the reciprocating motion along the first and second longitudinal axes is substantially coplanar.

18. In the Stirling cycle machine of claim 17, the improvement wherein the crankshaft coupling assembly further includes a fork coupling element connected between the first connecting rod and the crankshaft and a blade coupling element connected between the second connecting rod and the crankshaft.

19. In a Stirling cycle machine of the type wherein an displacer piston undergoes reciprocating motion along a first longitudinal axis in a first cylinder and a compression piston undergoes reciprocating motion along a second longitudinal axis in a second cylinder, the pistons being coupled to a crankshaft, the improvement comprising:

a pressure enclosure for containing a working fluid, the working fluid undergoing successive closed cycles of heating, expansion, cooling and compression;

at least one support bracket coupled to the pressure enclosure; and a bearing mount for supporting the crankshaft, the bearing mount coupled to the support bracket such that a dimensional change of the pressure enclosure is substantially decoupled from the bearing mount.

20. A method for aligning a piston in a cylinder, the piston undergoing reciprocating motion along a longitudinal axis and coupled to a guide link having a length, the method comprising:

providing a first guide element located along the length of the guide link, the first guide element having a spring mechanism for urging the guide element into contact with the guide link;

providing a second guide element in opposition to the first guide element, the second guide element having a precision positioner for positioning the second guide element with respect to the longitudinal axis;

moving the position of the second guide element so as to change the position of the guide link and the piston with respect to the longitudinal axis.

21. A method according to claim 20, wherein the first guide element is a roller having a center of rotation and a rim in rolling contact with the guide link and a second guide element is a roller having a center of rotation and a rim in rolling contact with the guide link.

22. A method according to claim 20, wherein the precision positioner is a vernier mechanism having an eccentric shaft for varying a distance between the second guide element and the longitudinal axis.

23. An alignment device for aligning a piston in a cylinder, the piston undergoing reciprocating motion along a longitudinal axis coupled to a guide link having a length, the alignment device comprising:

a first guide element located along the length of the guide link, the first guide element having a spring mechanism for urging the guide element into contact with the guide link; and a second guide element in opposition to the first guide element, the second guide element having a precision positioner for positioning the second guide element with respect to the longitudinal axis.

24. The alignment device of claim 23, wherein the precision positioner is a vernier mechanism having an eccentric shaft for varying a distance between the second guide element and the longitudinal axis.

25. A linkage for coupling a piston undergoing reciprocating linear motion along a longitudinal axis to a crankshaft undergoing rotary motion about a rotation axis of the crankshaft, the longitudinal axis and the rotation axis being substantially orthogonal to each other, the linkage comprising:

a guide link having a first end proximal to the piston, the first end coupled to the piston, and having a second end having a length and distal to the piston such that the rotation axis is disposed between the proximal end and the distal end of the guide link;

a connecting rod having a crankshaft end and a connecting end, the crankshaft end coupled to the crankshaft at a crankshaft connection point offset from the rotation axis of the crankshaft and the connecting end rotatably connected to the second end of the guide link at a rod connection point located along the length of the second end of the guide link, the rod connection point following a linear path along the longitudinal axis during the reciprocating linear motion of the piston; and a lateral support assembly in contact with the second end of the guide link at at least one lateral support point disposed along the linear path of the rod connection point.

26. A linkage according to claim 25, wherein the lateral support assembly is in rolling contact with the second end of the guide link.

27. A linkage according to claim 25, wherein the lateral support assembly comprises:

a first roller having a center of rotation fixed with respect to the rotation axis of the crankshaft and a rim in rolling contact with the second end of the guide link; and a second roller in opposition to the first roller, the second roller having a center of rotation and a rim in rolling contact with the second end of the guide link;

wherein the second end of the guide link is disposed between the first roller and the second roller.

28. A linkage for coupling a piston undergoing reciprocating linear motion along a longitudinal axis to a crankshaft undergoing rotary motion about a rotation axis of the crankshaft, the longitudinal axis and the rotation axis being substantially orthogonal to each other, the linkage comprising:

a guide link having a first end proximal to the piston, the first end coupled to the piston, and having a second end having a length and distal to the piston such that the rotation axis is disposed between the proximal end and the distal end of the guide link;

a guide link guide assembly for supporting lateral loads at the second end of the guide link, the guide link guide assembly having a first roller having a center of rotation fixed with respect to the rotation axis of the crankshaft and a rim in rolling contact with the second end of the guide link at a plurality of support points along the length of the second end of the guide link during reciprocating linear motion of the piston; and a connecting rod having a crankshaft end and a connecting end, the crankshaft end coupled to the crankshaft at a crankshaft connection point offset from the rotation axis of the crankshaft and the connecting end rotatably connected to the second end of the guide link at a rod connection point located along the length of the second end of the guide link, the rod connection point passing by at least one of the plurality of support points during the reciprocating linear motion of the guide link.

29. A linkage according to claim 28, wherein the guide link guide assembly further includes a second roller in opposition to the first roller, the second roller having a center of rotation and a rim in rolling contact with the second end off the guide link at a plurality of support points along the length of the second end of the guide link.

30. A linkage according to claim 29, wherein the second roller further includes a precision positioner to position the center of rotation of the second roller with respect to the longitudinal axis.

31. A linkage according to claim 30, where the precision positioner is a vernier mechanism having an eccentric shaft for varying the distance between the center of rotation of the second roller and the longitudinal axis.

32. A linkage according to claim 29, wherein a line defined by the centers of the first and second rollers includes the rod connection point when the crankshaft connection point is at a mid-stroke position.

* * * * *